US005353948A

United States Patent [19]

Lanoue et al.

[11] Patent Number: 5,353,948

[45] Date of Patent: Oct. 11, 1994

[54] PLASTIC CONTAINER WITH HINGED LIDS

[75] Inventors: Michel Lanoue, Ste-Foy; Roch Nolet, St-Joseph-de-Beauce, both of Canada

[73] Assignee: IPL Inc., Quebec, Canada

[21] Appl. No.: 57,707

[22] Filed: May 4, 1993

[51] Int. Cl.[5] ..... B65D 43/16

[52] U.S. Cl. ..... 220/343; 220/335; 220/334

[58] Field of Search ..... 206/508, 518, 519; 220/334, 335, 337, 342, 343, DIG. 6, 659

[56] References Cited

U.S. PATENT DOCUMENTS

| | | | |
|---|---|---|---|
| 3,005,572 | 10/1961 | Gustafson et al. | 220/659 |
| 3,295,714 | 1/1967 | Addario | 220/343 |
| 3,463,345 | 8/1969 | Bockenstette | 220/334 |
| 3,979,016 | 9/1976 | Frater | 220/334 |
| 4,161,261 | 7/1979 | Frater | 206/508 |
| 4,364,489 | 12/1982 | Alexeeff | 220/334 |
| 4,432,467 | 2/1984 | Swingley, Jr. | 220/334 |
| 4,620,644 | 11/1986 | Miller | 206/508 |
| 4,685,567 | 8/1987 | Webb | 206/508 |
| 4,688,675 | 8/1987 | Miller et al. | 206/508 |
| 4,765,480 | 8/1988 | Malmanger | 206/508 |
| 5,051,725 | 9/1991 | Caccitolo | 220/334 |

FOREIGN PATENT DOCUMENTS

| | | | |
|---|---|---|---|
| 1089786 | 11/1980 | Canada | 206/508 |

*Primary Examiner*—S. Castellano
*Attorney, Agent, or Firm*—Helfgott & Karas

[57] ABSTRACT

The present invention is concerned with a container consisting of a unitary body and of a pair of covering lids, the body and the lids being made of injection molded plastic material. The lids are hingedly connectable to the upper edges of the body through a snap engagement. The lids are thus formed of integral C-shaped projections along their longitudinal outer edge which engage onto integral hinge portions along the upper edge of the body side walls. The lids have their longitudinal inner edge constructed to define a trough allowing water collected on top of the lids to be dispensed trough appropriate openings in the end walls of the container body.

8 Claims, 4 Drawing Sheets

PLASTIC CONTAINER WITH HINGED LIDS

FIELD OF THE INVENTION

The present invention pertains to a container entirely made of injection molded plastic material and consisting of a body and of a pair of inter-engaging lids.

BACKGROUND OF THE INVENTION

At present, containers defining an enclosure formed of a body and of a pair of lids include elongated metallic rods extending through appropriate longitudinal openings alternatively provided along the upper edge of the body side walls and along the outer edge of the lids. Each time these containers need be washed, the metallic rods which are not removed cause corrosion.

Secondly, whenever these containers need be recycled, the rods must also be removed resulting additional costs. Furthermore, if a lid is damaged, it is not possible due to the particular fixing of the rod to the lid, to simply replace the lid; the entire container is scrapped.

A further disadvantage of the presence of metal in these containers is that, for certain type of contents (such as food), containers must pass through a metal detection system in order to detect the presence of undesired products in these contents. Evidently, the presence of the metallic rods acting as hinges affect the efficiency of the detection operation.

These containers have identification cards located directly above the handles; this causes problems as the cards are always dirty and damaged from such handling.

OBJECT AND STATEMENT OF THE INVENTION

An object of the present invention therefore is to overcome the above problems in providing a container formed of a body and of a pair of covering lids, both of which are entirely made of injection molded plastic material, without metallic components being present.

This object is achieved by providing the container with components which are only and entirely made of injection molded materials. This is further accomplished by structurally configuring the outer edges of the lids to easily engage and disengage complementary hinge portions along the upper edges of the side walls of the container body.

The present invention therefore relates to a container which comprises:

a) a unitary body made of injection molded plastic material having a bottom wall, opposite side walls and opposite end walls, each the side wall displaying, along an upper edge thereof, a series of longitudinally spaced recessed areas; each area displaying, lengthwise thereof, an integral hinge portion; and b) a pair of lids made of injection molded plastic material and hingedly connected to the upper edges of the body to move from an open position to an inter-engaging body-covering position; each lid has an inner longitudinal edge adapted to inter-engage with a complementarily-shaped inner longitudinal edge of the other lid and an outer longitudinal edge having a series of longitudinally spaced C-shaped integral projections adapted to be snappily engaged onto corresponding hinge portions of the upper edge of a side wall, the lids having opposite end edges adapted to rest on corresponding upper edges of the end walls.

A further object of the present invention is to provide the inner longitudinal edges of the lids with a construction which allows water collected on the lids to be directed to the opposite end walls of the container body and to be discharged through appropriate openings in its end walls.

An other object of the present invention is to provide, on the end walls, a configuration which allows an identifying card to be slid through an appropriate slot along the upper edge thereof which is thereafter covered by the opposite end edges of the lids.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIG. 9 is a cross-sectional view taken along lines 9—9 of FIG. 1.

DESCRIPTION OF PREFERRED EMBODIMENTS

Figure 1:
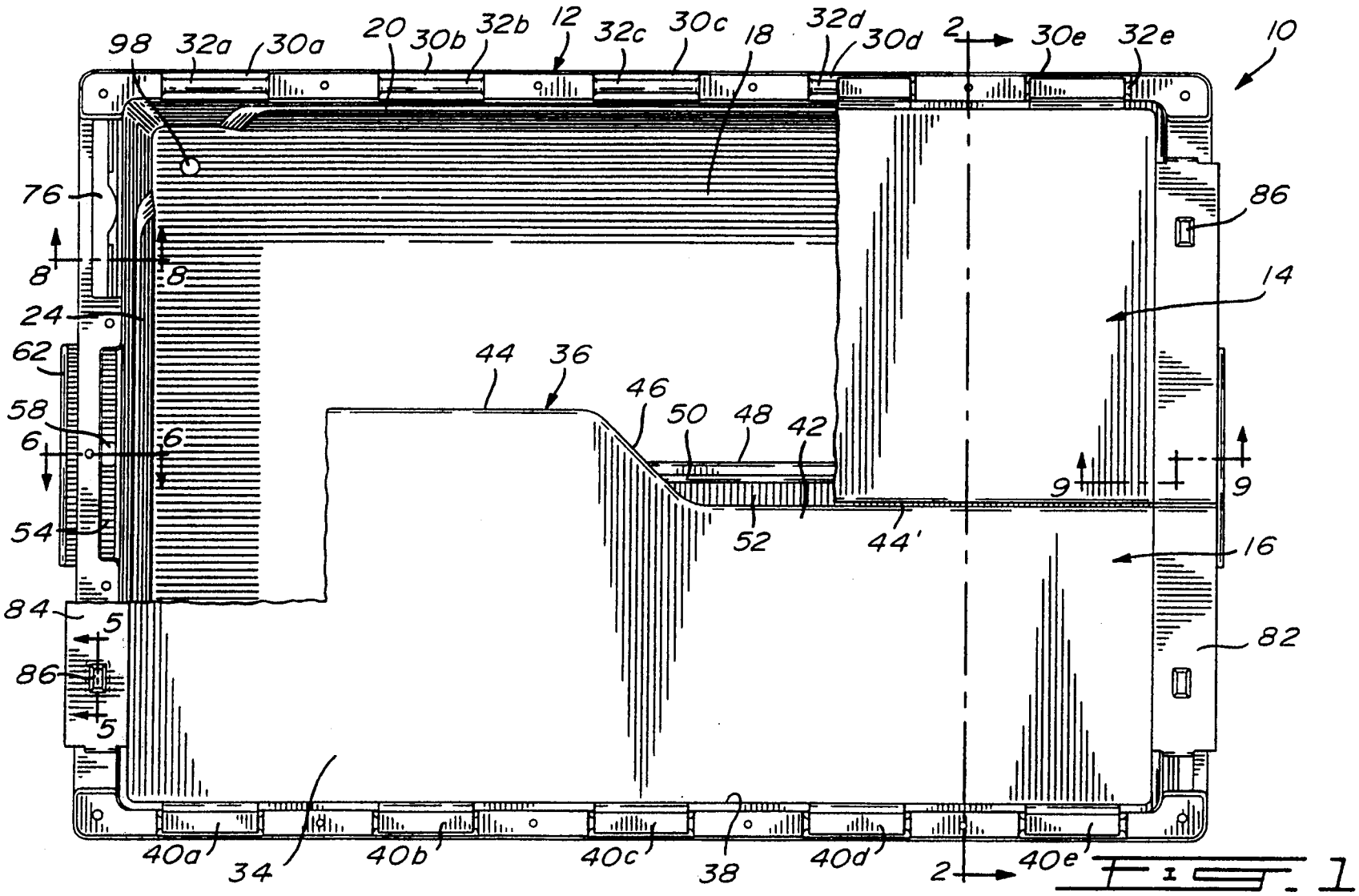
FIG. 1 is a top plan view of a container made in accordance with the present invention with parts of the lids being broken away for clarity.

Referring to FIG. 1, the container 10 of the present invention comprises three main components: a body 12 and a pair of lids 14 and 16. These three components are made of injection molded plastic material, as presently well known and used in present material handling containers.

Figure 2:
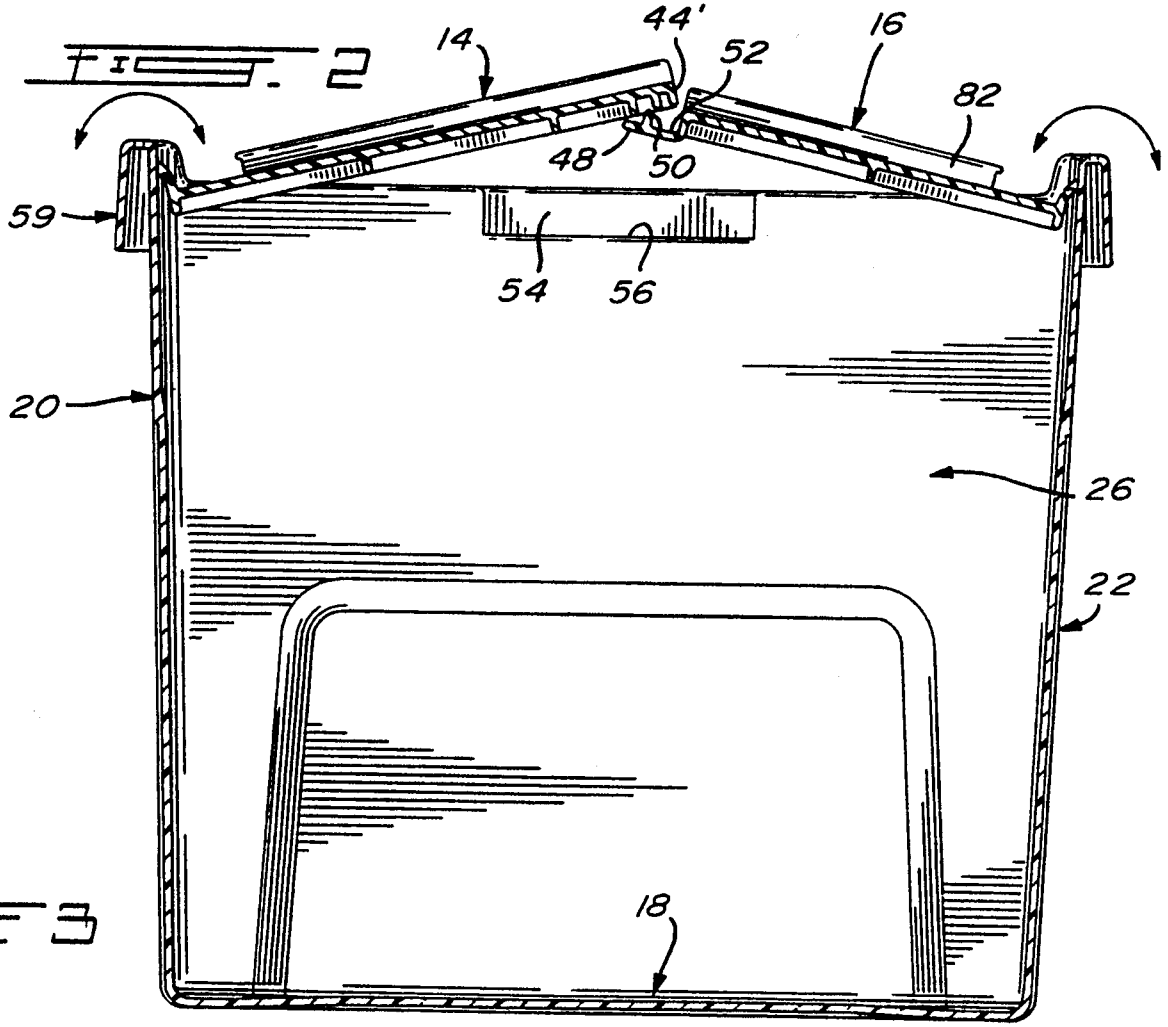
FIG. 2 is a cross-sectional view taken along lines 2—2 of FIG. 1.

Referring also to FIG. 2, body 12 comprises a bottom wall 18, a pair of opposite side walls 20 and 22 and a pair of opposite end walls 24 and 26. Side wall 20 is structurally identical to side wall 22 while end wall 24 is structurally identical end wall 26; hence, a detailed construction of one side wall and of one end wall will only be given.

The upper longitudinal edge of side wall 20 comprises a series of longitudinally spaced recessed areas 30*a*, 30*b*, 30*c*, 30*d* and 30*e* having a rectangular configuration and displaying, transversally thereof, an integral cylindrical portion 32*a*, 32*b*, 32*c*, 32*d* and 32*e*, each defining a hinge as hereinafter described.

Lids 14 and 16 are identically shaped and constructed; therefore, only one lid will be described.

Figure 3:
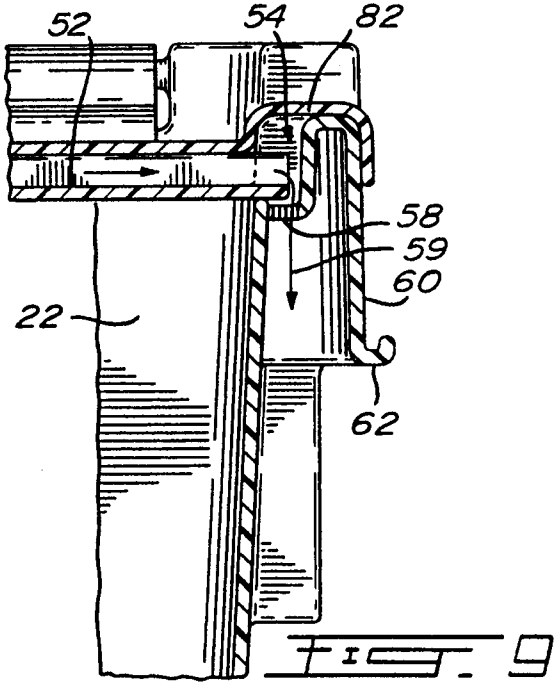
FIG. 3 is an enlarged cross-sectional view showing a lid in an open downwardly depending position.
Figure 5:
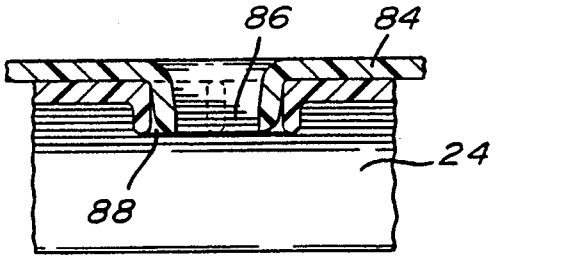

Lid 16 comprises a substantially rectangular top surface 34 having an inner longitudinal edge 36 and an outer longitudinal edge 38. A series of longitudinally spaced C-shaped integral projections 40*a*, 40*b*, 40*c*, 40*d* and 40*e* extend from edge 38. As can be seen in FIG. 3, the C-shaped projection has an inner diameter corresponding substantially to the outer diameter of the hinge portion 32*a*, the opening of the C-shaped projection being slightly smaller than the diameter of the hinge portion 32*a*. However, due to the resiliency of the plastic material, a snap-in engagement is made possible between the lid projections with corresponding hinge portions on the side wall of the body.

Figure 4:
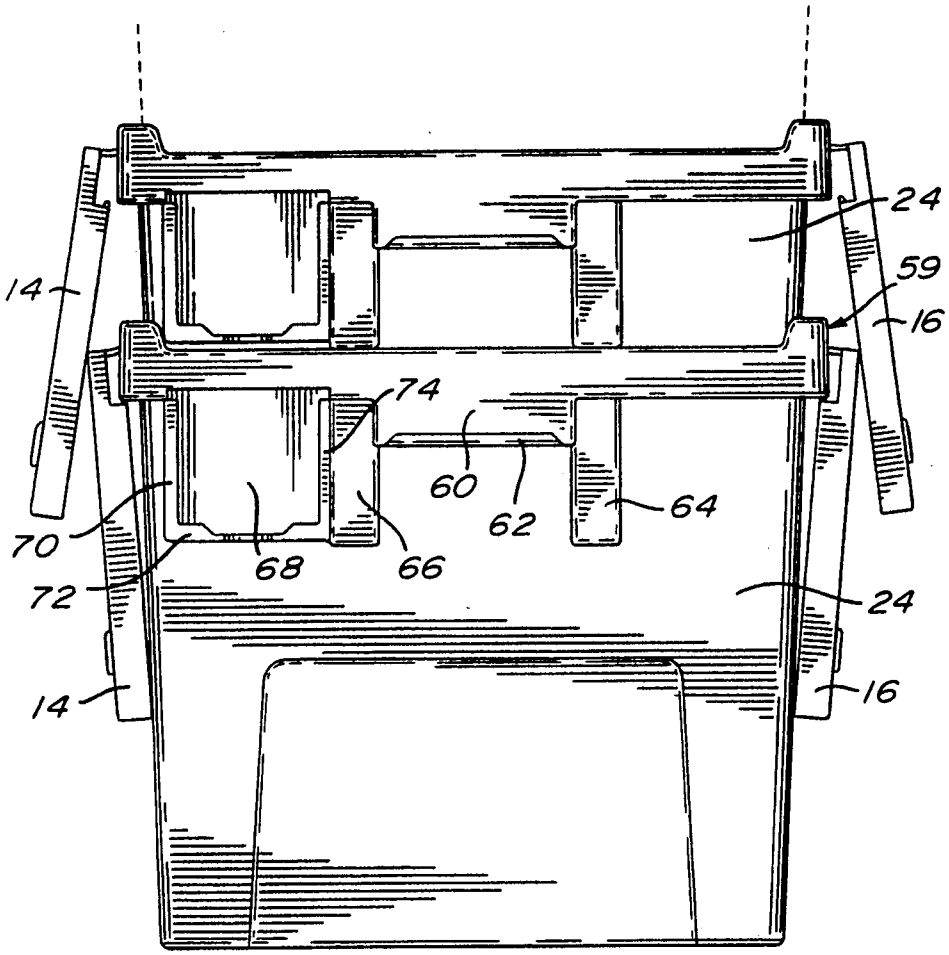
FIG. 4 is an end view of two nested containers made in accordance with the present invention.

Referring to FIG. 4, it can be seen that, when the lids are in the opened position, similarly constructed containers may be nested one within the other; the lids of an upper container resting on the lids of the lower disposed container.

As shown in FIG. 1, the longitudinal inner edge of the lid 16 comprises a first inner half portion 42, a second outer half portion 44 and an intermediate oblique portion 46. Half portion 42 has a projecting lower flange 48 with a longitudinal vertical wall 50 defining a trough 52 that extends from the oblique portion 46 to the opposite end wall of the container. The outer half portion 44' of lid 14 covers this flange 48 and the trough 52. As shown in FIG. 2, the end wall 26 has a rectangular L-shaped recessed area 54 at its upper edge, the bottom wall 56 of which has a hole 58 (see FIG. 9). The outer end of the trough terminates vertically above the recessed area so that water collected on the top face of the lids and dripping through the narrow gap separating the adjacent inner edges of the lid and falling into the trough 52 is discharged (as indicated by arrow 59) at these outer ends into the recessed area 54 to exit through holes 58.

It has been found that the present invention is also useful with containers having lids half the size of the lids described above hence without the irrigation troughs along their inner edge. Such construction provides a central spacing to enable ventilation of the products inside the containers while still permitting stacking and nesting.

Figure 7:
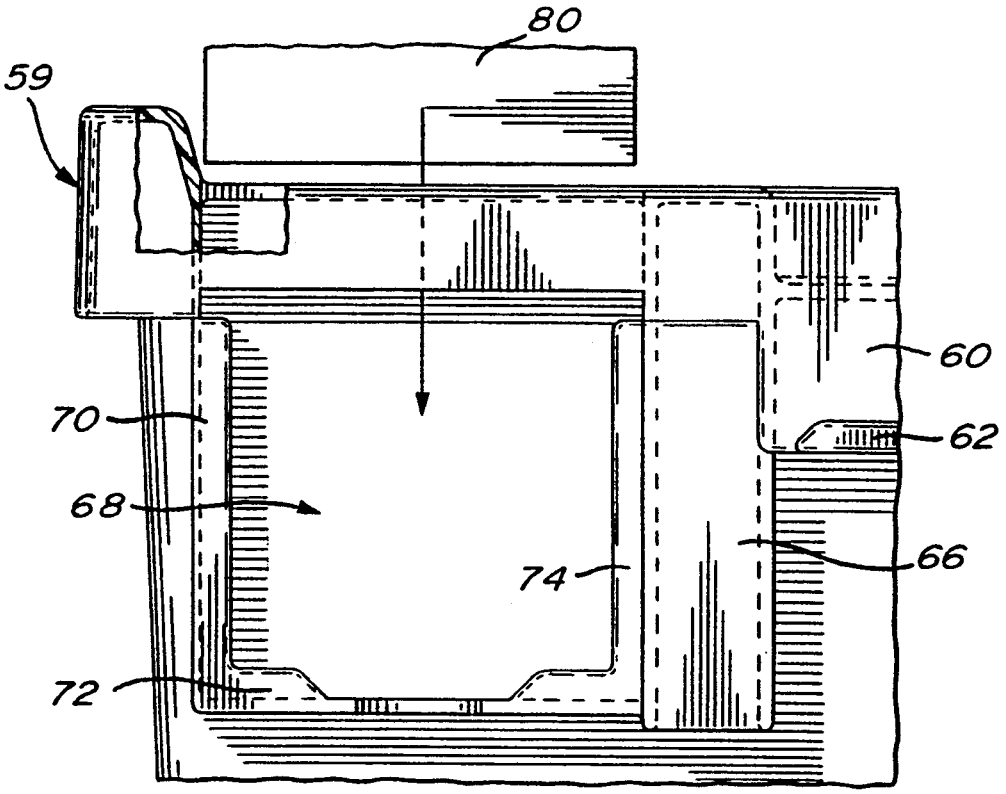
FIG. 7 is a partial end view of the container showing a card receiving area on an end wall thereof.
Figure 8:
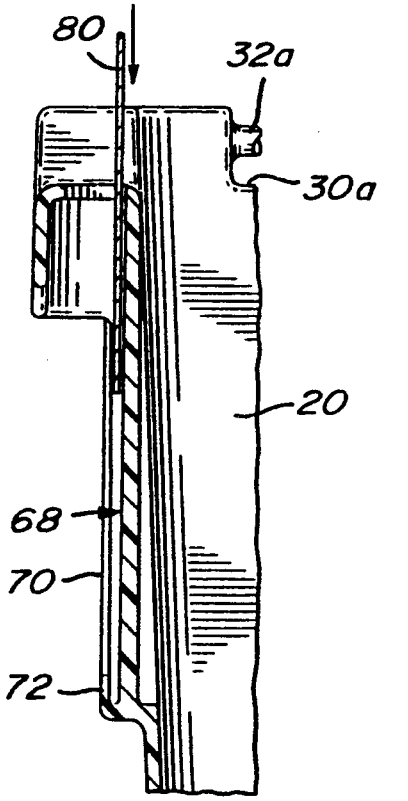
FIG. 8 is a cross-sectional view taken along lines 8—8 of FIG. 1.
Figure 6:
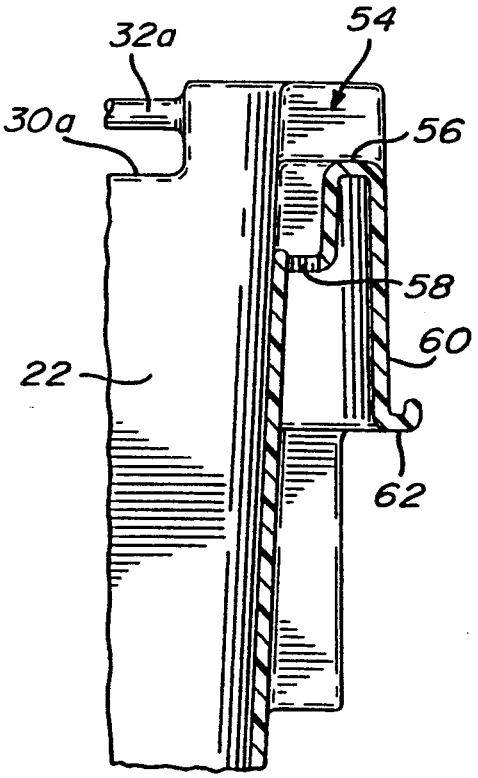
FIG. 6 is a cross-sectional view taken along lines 6—6 of FIG. 1.

As can be seen in FIGS. 4 and 7, the entire peripheral upper edge of the body displays an outward flange 59 defining a double wall. In the opposite end walls, this double wall has an enlarged central area 60 defining a handle with a rounded lower edge 62 to provide a smooth hand gripping area. The end wall also includes two rectangular hollow vertical reinforcing projections 64 and 66 on either side of the handle 60. These projections serve as posts with their lower edge resting on the upper edge of a lower disposed container when the lids are in the open position and similarly constructed containers are nested in one another. Next to projection 66, a configuration 68 formed of three L-shaped flanges 70, 72 and 74 is defined to receive a card identifying the contents placed in the container. As can be seen in FIG. 1, the upper edge of the end wall has a slot 76 in which is slid a card 80 (FIG. 8), the edges of which will be contained within the L-shaped flanges 70, 72 and 74 of the receiving area 68.

As shown in FIGS. 1 and 9, the opposite end edges of the lids 14 and 16 each has an inverted U-shaped extension 82, 84 which will rest on the opposite upper edges of the end walls 24 and 26 when the lids are in their inter-engaged closed position; this extension covers slot 76 to thereby confine the card 80 within its receiving area 68.

Figure 5:
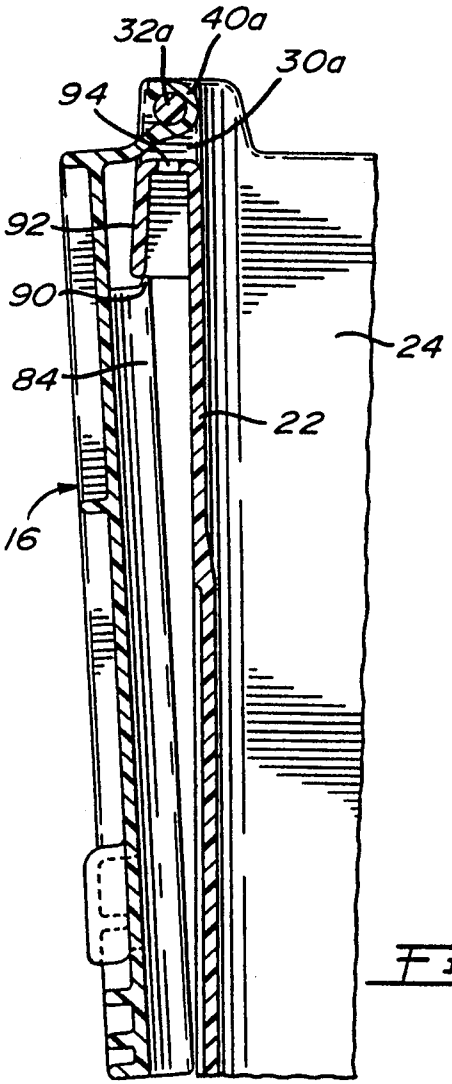
FIG. 5 is a cross-sectional view taken along lines 5—5 of FIG. 1.

As can be seen in FIG. 5, the inverted U-shaped extension 84 has a recessed area 86 adapted to fit into a corresponding opening 88 formed in the upper edge of the end wall 24. This allows a locking device (not shown) to be received to secure the lids to the container body.

One of the advantage of having a container made entirely of injection molded material is that it can be washed without even disengaging the lids from the container. To facilitate the handling of a container being washed, the innermost end of the inverted U-shaped extension 84 has a lip 90 (see FIG. 3) which snaps under the outer over-hanging wall 92 of the double wall 59. The dimension of this lip is such as to be resiliently snapped in engagement behind wall 92. Also, the double wall 59 has a series of openings 94 which will now washing water to the dispensed therethrough should the container be washed upside down.

Also, the bottom wall 18 has a series of openings 98 allowing water collected on the bottom wall to be discharged therethrough.

Although the invention has been described above in relation to one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A container comprising:

a) a unitary body made of injection molded plastic material having a bottom wall, opposite side walls and opposite end walls, each said side wall displaying, along an upper edge thereof, a series of longitudinally spaced recessed areas, each area displaying, lengthwise thereof, a hinge portion integrally formed with said upper edge of the respective side wall; and b) a pair of lids made of injection molded plastic material and hingedly connected to said upper edges of said side walls of said body to move from an open position to an inter-engaging body-covering position; each said lid having an inner longitudinal edge inter-engaging, when in the body-covering position, with a complementarily shaped inner longitudinal edge of the other lid, and an outer longitudinal edge having a series of longitudinally spaced C-shaped integral projections snappily engaged with the hinge portions integral with the upper edge of the respective side wall, said lids having opposite end edges which rest on corresponding upper edges of said end walls;

said inner longitudinal edge of each lid including:

a first half portion defining a water collecting trough; and a second half portion defining a covering extension which lies over the first half portion of the other lid when in the body-covering position, wherein the upper edges of the end walls each define L-shaped recessed areas; said troughs of said lids having opposite ends thereof terminating over said recessed areas; said recessed areas each having a bottom wall provided with an opening therethrough.

2. A container as defined in claim 1, wherein the upper edges of the end walls define a double wall; the opposite end edges of the lids having inverted U-shaped projections which fit over the double wall when the lids are in the body-covering position.

3. A container as defined in claim 2, wherein the double walls and the U-shaped projections have openings in registry so as to allow insertion of a locking device therein.

4. A container as defined in claim 2, wherein each double wall of the end walls includes downwardly extended portions in the central area thereof defining handles for carrying the container.

5. A container as defined in claim 2, wherein each said end wall includes, on an outer face thereof, a protuberation defining a U-shaped configuration to receive a label carrying card therein; the upper edges of the end walls over said protuberations including a longitudinal card-inserting slot; said slot being covered by said inverted U-shaped projection of the opposite end edge of a lid when in the body-covering position.

6. A container as defined in claim 1, wherein the upper edges of the side walls define a double wall.

7. A container as defined in claim 6, wherein said double wall includes water discharging holes.

8. A container as defined in claim 6, wherein the opposite end edges of the lids have a lip portion engaging a lower edge of an outer wall of said double wall to retain said lid when in the open position.

* * * * *